US008693637B2

(12) United States Patent
Lee et al.

(10) Patent No.: US 8,693,637 B2
(45) Date of Patent: Apr. 8, 2014

(54) APPARATUS AND METHOD FOR GENERATING X-RAY USING ELECTRON CYCLOTRON RESONANCE ION SOURCE

(75) Inventors: Byoung Seob Lee, Daejeon (KR); Mi Sook Won, Busan (KR); Jang Hee Yoon, Busan (KR); Jin Yong Park, Busan (KR); Se Yong Choi, Gyeonggi-do (KR)

(73) Assignee: Korea Basic Science Institute (KR)

( * ) Notice: Subject to any disclaimer, the term of this patent is extended or adjusted under 35 U.S.C. 154(b) by 0 days.

(21) Appl. No.: 13/475,465

(22) Filed: May 18, 2012

(65) Prior Publication Data

US 2012/0230472 A1 Sep. 13, 2012

Related U.S. Application Data

(63) Continuation of application No. PCT/KR2010/008543, filed on Dec. 1, 2010.

(30) Foreign Application Priority Data

Dec. 1, 2009 (KR) ..... 10-2009-0117680

(51) Int. Cl.
*H01J 33/02* (2006.01)

(52) U.S. Cl.
USPC ..... 378/121; 378/119

(58) Field of Classification Search
None
See application file for complete search history.

(56) References Cited

U.S. PATENT DOCUMENTS

| | | | | |
|---|---|---|---|---|
| 4,771,447 | A | 9/1988 | Saitoh et al. | |
| 5,355,399 | A | 10/1994 | Golovanivsky et al. | |
| 6,327,338 | B1 | 12/2001 | Golovanivsky et al. | |
| 2010/0032587 | A1 * | 2/2010 | Hosch et al. | 250/492.3 |
| 2011/0140641 | A1 * | 6/2011 | Won et al. | 315/502 |

FOREIGN PATENT DOCUMENTS

| | | | |
|---|---|---|---|
| JP | 2009102668 | A | 5/2009 |
| KR | 100927995 | B1 | 11/2009 |

OTHER PUBLICATIONS

International Search Report and Written Opinion of the International Searching Authority; Application No. PCT/KR2010/008543; Issued: Jun. 24, 2011; Mailing Date: Jul. 18, 2011; 6 pages.

* cited by examiner

*Primary Examiner* — Hoon Song
*Assistant Examiner* — Danielle Fox
(74) *Attorney, Agent, or Firm* — St. Onge Stewart Johnston & Reens LLC

(57) ABSTRACT

An apparatus for generating X-ray may include: a plasma chamber; a magnet unit for applying a magnetic field to the plasma chamber, the magnet unit configured to allow the control of the magnitude of the minimum magnetic field in the plasma chamber without change in structure; a microwave generator for applying microwaves to the plasma chamber; a reaction gas injected into the plasma chamber for generating X-ray through electron cyclotron resonance by the magnetic field and the microwaves; a variable guide for focusing the generated X-ray; and a variable extractor for outputting the focused X-ray from the plasma chamber.

9 Claims, 1 Drawing Sheet

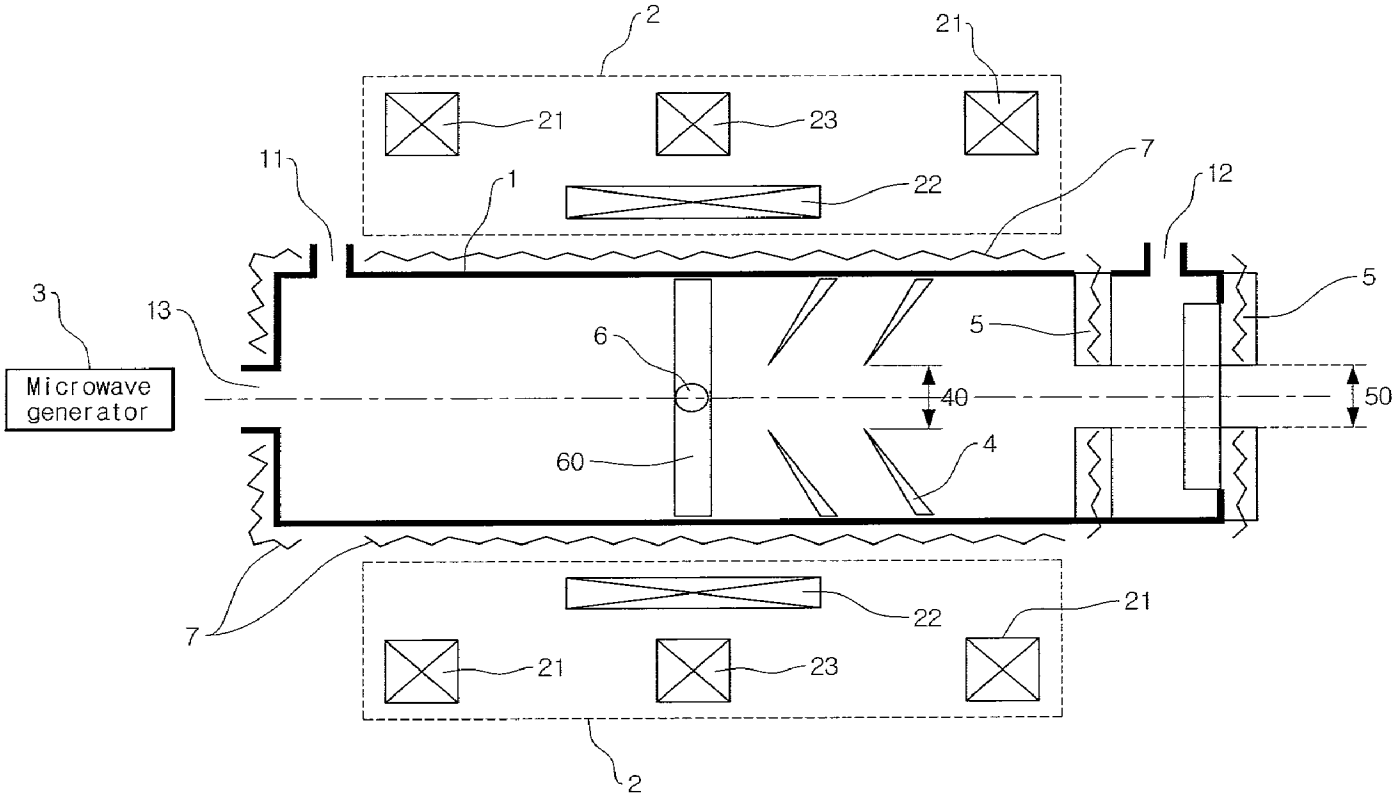
5
50
12
7
21
5
4
40
22
23
2
6
60
1
11
13
3
Microwave generator

APPARATUS AND METHOD FOR GENERATING X-RAY USING ELECTRON CYCLOTRON RESONANCE ION SOURCE

CROSS-REFERENCE TO RELATED APPLICATIONS

The present application is a continuation of pending International patent application PCT/KR2010/008543 filed on Dec. 1, 2010 which designates the United States and claims priority from Korean patent application 10-2009-0117680 filed on Dec. 1, 2009, the content of which is incorporated herein by reference.

FIELD OF THE INVENTION

Apparatus And Method For Generating X-Ray Using Electron Cyclotron Resonance Ion Source.

BACKGROUND OF THE INVENTION

Embodiments relate to an apparatus for generating X-ray and a method for generating X-ray using an electron cyclotron resonance ion source.

In general, radionuclides or high-voltage vacuum tubes are used in many applications requiring X-ray. As an X-ray source, the radionuclide is inconvenient because of generally short lifetime and the danger related with the handling thereof. Further, the employment of the high-voltage vacuum tube requires the use of a high-voltage device, since the X-ray is produced by accelerated electrons, resulting in increased weight and danger.

To cope with this problem, an electron cyclotron resonance (ECR) apparatus based on 2.45 GHz microwaves was proposed as a source of soft X-ray. However, although the cost of the 2.45 GHz microwave generator and the electromagnet (or a permanent magnet which is less expensive) is relatively low, the cost related with the vacuum device and the plasma chamber required to generate the electron cyclotron resonance plasma increases. Thus, the economic gain is not so large.

Further, when the output of the microwave is increased or high frequency is employed to generate high-intensity X-rays, it is difficult to control the unidirectionality of the generated X-ray and the ions generated by electron cyclotron resonance damage the radiographic quality. Thus, it is uncompetitive with other existing apparatuses for generating X-ray.

Recently, the applications of the apparatuses for generating X-ray are expanding greatly over medicine, nanotechnology, biotechnology and many other industries. Accordingly, the applications requiring high-intensity X-ray are increasing as well as those requiring low-intensity X-ray. However, the conventional high-intensity apparatuses for generating X-ray using the high-voltage vacuum tubes are very expensive, and thus, are limited in their use.

SUMMARY OF THE INVENTION

According to an aspect of the invention, an apparatus for generating X-ray employing an electron cyclotron resonance (ECR) ion source as a basic device for generating X-ray, which is capable of adequately controlling unidirectionality and output of X-ray, and a method for generating X-ray using the same may be provided.

According to an embodiment, an apparatus for generating X-ray may include: a plasma chamber; a magnet unit for applying a magnetic field to the plasma chamber, the magnet unit configured to allow the control of the magnitude of the minimum magnetic field in the plasma chamber without change in structure; a microwave generator for applying microwaves to the plasma chamber; a reaction gas injected into the plasma chamber for generating X-ray through electron cyclotron resonance by the magnetic field and the microwaves; a variable guide for focusing the generated X-ray; and a variable extractor for outputting the focused X-ray from the plasma chamber.

According to another embodiment, there is provided a method for generating X-ray including: injecting a reaction gas into a plasma chamber; applying a magnetic field and microwaves to the reaction gas; controlling the magnitude of the minimum magnetic field applied to the reaction gas according to the intensity of the X-ray to be generated; generating X-ray from the reaction gas through electron cyclotron resonance by the magnetic field and the microwaves; focusing the generated X-ray using a variable guide; and outputting the focused X-ray through a variable extractor.

The apparatus for generating X-ray according to an aspect of the invention provides the following advantages.

Firstly, compared with the conventional apparatus for generating X-ray consisting of a high frequency generator, a vacuum device and a gas injection device and configured to control the output by controlling or replacing an X-ray generating material, the apparatus for generating X-ray according to an aspect of the invention employs a magnet unit capable of controlling the magnetic field and thus allows easy and accurate output control. Further, since the output is controlled by means of software, the output can be increased at low cost.

Secondly, the employment of the variable guide improves unidirectionality of X-ray and reduces and/or prevents degradation of radiographic quality caused by the ions generated along with the X-ray. Further, the outputting of the X-ray using the variable extractor allows the apparatus for generating X-ray to be applicable to various applications.

Thirdly, whereas the conventional apparatus for generating X-ray requires a large and expensive high frequency generator, the apparatus for generating X-ray according to an aspect of the invention may have a small-sized plasma chamber and allow generation of high-intensity X-ray at low cost since costs related to the vacuum device are reduced.

BRIEF DESCRIPTION OF THE DRAWINGS

The above and other aspects, features and advantages of the disclosed exemplary embodiments will be more apparent from the following detailed description taken in conjunction with the accompanying drawings in which:

FIG. 1 is a cross-sectional view schematically illustrating an apparatus for generating X-ray according to an embodiment.

DETAILED DESCRIPTION OF THE INVENTION

Exemplary embodiments now will be described more fully hereinafter with reference to the accompanying drawings, in which exemplary embodiments are shown. This disclosure may, however, be embodied in many different forms and should not be construed as limited to the exemplary embodiments set forth therein. Rather, these exemplary embodiments are provided so that this disclosure will be thorough and complete, and will fully convey the scope of this disclosure to those skilled in the art. In the description, details of well-known features and techniques may be omitted to avoid unnecessarily obscuring the presented embodiments.

The terminology used herein is for the purpose of describing particular embodiments only and is not intended to be limiting of this disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item. The use of the terms "first", "second", and the like does not imply any particular order, but they are included to identify individual elements. Moreover, the use of the terms first, second, etc. does not denote any order or importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

FIG. 1 is a cross-sectional view schematically illustrating an apparatus for generating X-ray according to an embodiment.

Referring to FIG. 1, an apparatus for generating X-ray may comprise a plasma chamber 1, a reaction gas (not shown) inside the plasma chamber 1, a magnet unit 2, a microwave generator 3, a variable guide 4 and a variable extractor 5.

The plasma chamber 1 provides a space for electron cyclotron resonance (ECR) to occur. The plasma chamber 1 may have an inlet port 11 and an outlet port 12. The inlet port 11 is a portion where the reaction gas for generating plasma is injected into the plasma chamber 1, and the outlet port 12 is a portion where the gas inside the plasma chamber 1 is discharged outward. The outlet port 12 may be connected, for example, to a vacuum pump (not shown). Further, the plasma chamber 1 may have a microwave inlet port 13 for application of microwaves.

The reaction gas that may be injected through the inlet port 11 into the plasma chamber 1 may be various substances capable of generating plasma. For example, argon (Ar) or xenon (Xe) gas may be used as the reaction gas. The degree of vacuum in the plasma chamber 1 may be determined adequately depending on the particular reaction gas, such that electron cyclotron resonance may occur. That is to say, the pressure inside the plasma chamber 1 may be controlled by discharging the gas in the plasma chamber 1 outwards through the outlet port 12.

The plasma chamber 1 may have a circular cross-section as shown in FIG. 1. For example, the plasma chamber 1 may have a cylindrical shape with a cross-section cut perpendicular the length direction thereof being circular. However, this is only exemplary, and the plasma chamber 1 may have other appropriate shapes.

The magnet unit 2 applies a magnetic field to the plasma chamber 1 to induce electron cyclotron resonance. In an embodiment, the magnet unit 2 may include mirror magnets 21, a polarizing magnet 22 and an adjusting magnet 23. The mirror magnets 21 may be provided outside the plasma chamber 1, in proximity to both ends of the plasma chamber 1. The polarizing magnet 22 may be provided outside the plasma chamber 1, between the mirror magnets 21. Electrons may be captured inside the plasma chamber 1 by a mirror magnetic field applied by the mirror magnets 21 and a magnetic field applied by the polarizing magnet 22.

The adjusting magnet 23 may be provided outside the plasma chamber 1, between the mirror magnets 21. The adjusting magnet 23 may be provided in proximity to the center portion of the plasma chamber 1 at which the magnitude of the mirror magnetic field by the mirror magnets 21 is smallest. The adjusting magnet 23 may be configured to allow the control of the magnitude of the magnetic field applied by the adjusting magnet 23 without change in structure. For example, the adjusting magnet 23 may comprise an electromagnet allowing the control of the magnetic field by means of software. By controlling the magnitude of the minimum magnetic field in the plasma chamber 1 using the adjusting magnet 23, the intensity of the X-ray to be generated in the plasma chamber 1 may be controlled.

In FIG. 1, the magnets 21, 22, 23 of the magnet unit 2 may have rectangular-shaped cross-sections and enclose the plasma chamber 1. For example, each magnet 21, 22, 23 may have a hollow ring shape. The plasma chamber 1 may be disposed in the hollow center portions of the mirror magnets 21 and the adjusting magnet 23, and the hollow center of the polarizing magnet 22 may be aligned along the length direction of the plasma chamber 1, in proximity to the plasma chamber 1. However, this is only exemplary, and each magnet 21, 22, 23 may have other shapes appropriate to apply the magnetic field to the plasma chamber 1.

The microwave generator 3 generates microwaves and applies them into the plasma chamber 1. For example, the microwave generator 3 may comprise an oscillator such as a magnetron or a gyrotron. The microwave generator 3 may apply microwaves to the reaction gas in the plasma chamber 1 through the microwave inlet port 13 of the plasma chamber 1. When microwaves are applied to the reaction gas in the plasma chamber 1 in an adequate magnetic field under an adequate gas atmosphere, electron cyclotron resonance occurs.

As a result of the electron cyclotron resonance, cations are generated. By utilizing the chamber wall and the guide as electrodes, the distribution of electrons and cations in the region of the electron cyclotron resonance may be varied.

The intensity of the X-ray generated in the plasma chamber 1 may be controlled by controlling the microwaves applied by the microwave generator 3. Alternatively, the X-ray intensity may be increased by varying the voltage applied to the portion of the plasma chamber 1 in proximity to the microwave generator 3.

In an embodiment, the apparatus for generating X-ray may further comprise a target material 6 disposed in the plasma chamber 1. For example, the target material 6 may be disposed in a propagation path of the microwaves as supported by a support 60. Even without the target material 6, the X-ray may be generated from the reaction gas. However, by colliding electrons accelerated by the electron cyclotron resonance with the target material 6, the X-ray may be generated more easily. The target material 6 may comprise a metal such as molybdenum (Mo) or tungsten (W) or other adequate materials for control of the intensity and energy of the X-ray. Further, the intensity and energy of the X-ray may be controlled by adjusting the size and location of the target material 6.

The X-ray generated by the electron cyclotron resonance does not have specific directionality but is emitted in all directions. The variable guide 4 may focus the X-ray so that it has unidirectionality. The variable guide 4 may be configured such that the center portion thereof protrudes slantly toward the propagation direction of the microwaves. Further, the variable guide 4 may have a hole 40 at the center portion thereof to allow the X-ray to pass through. For example, the variable guide 4 may have a circular disc shape with a protruding center portion and a hole formed at the center portion.

The variable guide 4 may be formed of metal or other adequate conducting materials. The X-ray intensity may be controlled by changing the distribution density of electrons by varying the voltage applied to the variable guide 4, thus varying the electric field. The shape of the variable guide 4, such as the angle of the variable guide 4 with respect to the propagation direction of the microwaves or the size and shape of the hole 40, may be changed to focus the X-ray passing through the variable guide 4.

Ions may be captured inside the plasma chamber 1 due to the electric field formed by the variable guide 4. As such, since the ions are captured in the plasma chamber 1 while the X-ray is output from the apparatus for generating X-ray, damage of radiographic quality by the ions may be reduced and/or prevented.

The X-ray focused by the variable guide 4 may pass through the variable extractor 5 and be output from the plasma chamber 1. The variable extractor 5 may be formed of a material capable of shielding X-ray and may have, in part, a hole 50 to allow the X-ray to pass therethrough. For example, the variable extractor 5 may comprise lead (Pb), tantalum (Ta), tungsten (W) or other adequate materials. By changing the shape of the variable extractor 5, such as the size and shape of the hole 50, the area of the X-ray output from the apparatus for generating X-ray through the variable extractor 5 may be controlled to suit the desired purpose.

In an embodiment, the apparatus for generating X-ray may further comprise a shield 7 disposed to enclose, at least in part, the outer wall of the plasma chamber 1. The shield 7 shields the X-ray emitted through the outer wall of the plasma chamber 1 in order to protect other equipments or the operator. For example, the shield 7 may comprise lead (Pb), tantalum (Ta), tungsten (W) or other adequate materials.

The shape and size of each component of the apparatus for generating X-ray described above are given as examples to illustrate the principle of the apparatus for generating X-ray according to the invention and are not to be interpreted be limitative.

Hereinafter, a method for generating X-ray according to an embodiment will be described. For the brevity of the explanation, the method for generating X-ray will be described referring to the apparatus for generating X-ray illustrated in FIG. 1.

First, a reaction gas (not shown) may be injected into a plasma chamber 1. At this time, the pressure of the reaction gas inside the plasma chamber 1 may be controlled adequately using an inlet port 11 and an outlet port 12, such that electron cyclotron resonance may occur.

Then, a magnetic field may be applied to the plasma chamber 1 using a magnet unit 2, while applying microwaves to the plasma chamber 1 using a microwave generator 3. Electrons and ions may be generated from the reaction gas by the microwaves, and the electrons may be accelerated by electron cyclotron resonance due to the magnetic field and the microwaves, thus generating X-ray. The output of the microwaves may be controlled adequately depending on the desired intensity of the X-ray to be generated.

Also, the magnitude of the minimum magnetic field applied to the plasma chamber 1 may be controlled by controlling the magnetic field applied by an adjusting magnet 23 of the magnet unit 2. Since the intensity of the X-ray varies depending on the magnitude of the minimum magnetic field in the plasma chamber 1, X-ray with desired intensity may be generated by controlling the magnetic field applied by the adjusting magnet 23.

Then, the generated X-ray may be focused to have unidirectionality using a variable guide 4. The variable guide 4 may be configured such that the ions are captured in the plasma chamber 1 while the X-ray is output. The X-ray intensity may be controlled by changing the distribution density of electrons by varying the voltage applied to the variable guide 4, thus varying the electric field. The shape of the variable guide 4, such as the angle of the variable guide 4 with respect to the propagation direction of the microwaves or the size and shape of a hole 40, may be changed to focus the X-ray passing through the variable guide 4.

Then, the X-ray focused by the variable guide 4 may be output through a variable extractor 5. The X-ray may be output through a hole 50 of the variable extractor 5. By changing the shape of the variable extractor 5, such as the size and shape of the hole 50, the area of the X-ray output through the variable extractor 5 may be controlled to suit the desired purpose.

While the exemplary embodiments have been shown and described, it will be understood by those skilled in the art that various changes in form and details may be made thereto without departing from the spirit and scope of this disclosure as defined by the appended claims. In addition, many modifications can be made to adapt a particular situation or material to the teachings of this disclosure without departing from the essential scope thereof. Therefore, it is intended that this disclosure not be limited to the particular exemplary embodiments disclosed as the best mode contemplated for carrying out this disclosure, but that this disclosure will include all embodiments falling within the scope of the appended claims.

INDUSTRIAL APPLICABILITY

Embodiments relate to an apparatus for generating X-ray and a method for generating X-ray using an electron cyclotron resonance ion source.

What is claimed is:

1. An apparatus for generating X-ray using electron cyclotron resonance, the apparatus comprising:

a plasma chamber;

a magnet unit for applying a magnetic field to the plasma chamber, the magnet unit configured to allow the control of the magnitude of the minimum magnetic field in the plasma chamber without change in structure;

a microwave generator for applying microwaves to the plasma chamber;

a reaction gas injected into the plasma chamber;

a variable guide for focusing the generated X-ray; and a variable extractor for outputting the focused X-ray from the plasma chamber, wherein the magnetic unit and the microwave generator are configured to induce electron cyclotron resonance in the plasma chamber by the magnetic field and the microwaves, and wherein an X-ray is generated from electrons accelerated by the electron cyclotron resonance.

2. The apparatus for generating X-ray according to claim 1, further comprising a target material disposed in the plasma chamber for generating X-ray as accelerated electrons collide therewith.

3. The apparatus for generating X-ray according to claim 1, wherein the magnet unit comprises:

mirror magnets disposed outside both ends of the plasma chamber;

a polarizing magnet disposed outside the plasma chamber between the mirror magnets; and an adjusting magnet disposed outside the plasma chamber between the mirror magnets and configured to allow the control of the magnitude of the magnetic field.

4. The apparatus for generating X-ray according to claim 1, further comprising a shield disposed outside the plasma chamber for shielding X-ray emitted through an outer wall of the plasma chamber.

5. The apparatus for generating X-ray according to claim 1, wherein the intensity of the X-ray output from the apparatus for generating X-ray is controlled by varying a voltage applied to the variable guide.

6. The apparatus for generating X-ray according to claim 1, wherein the degree of focusing of the X-ray output from the apparatus for generating X-ray is controlled by varying the shape of the variable guide.

7. The apparatus for generating X-ray according to claim 1, wherein the area on which the X-ray is output from the apparatus for generating X-ray is controlled by varying the shape of the variable extractor.

8. A method for generating X-ray using electron cyclotron resonance, the method comprising:

injecting a reaction gas into a plasma chamber;

applying a magnetic field and microwaves to the reaction gas so as to induce electron cyclotron resonance in the plasma chamber;

controlling the magnitude of the minimum magnetic field applied to the reaction gas according to the intensity of the X-ray to be generated;

generating X-ray from electrons accelerated by the electron cyclotron resonance due to the magnetic field and the microwaves;

focusing the generated X-ray using a variable guide; and outputting the focused X-ray through a variable extractor.

9. The method for generating X-ray according to claim 8, wherein said generating the X-ray comprises colliding accelerated electrons with a target material so as to generate the X-ray.

* * * * *